US007431094B2

(12) United States Patent
De Clute-Melancon

(10) Patent No.: US 7,431,094 B2
(45) **Date of Patent: *Oct. 7, 2008**

(54) METHOD FOR UTILIZING DOWNHOLE SAFETY JOINT

(75) Inventor: Daniel Aaron De Clute-Melancon, Franklin, LA (US)

(73) Assignee: Halliburton Energy Services, Inc., Duncan, OK (US)

( * ) Notice: Subject to any disclaimer, the term of this patent is extended or adjusted under 35 U.S.C. 154(b) by 7 days.

This patent is subject to a terminal disclaimer.

(21) Appl. No.: 11/373,566

(22) Filed: Mar. 10, 2006

(65) Prior Publication Data

US 2007/0209803 A1 Sep. 13, 2007

(51) Int. Cl.
*E21B 17/06* (2006.01)

(52) U.S. Cl. ..... 166/377; 166/242.6; 175/320

(58) Field of Classification Search ..... 175/320; 166/242.6, 242.7, 377; 403/348, 349; 285/922
See application file for complete search history.

(56) References Cited

U.S. PATENT DOCUMENTS 2,197,344 A * 4/1940 Matlock ..... 175/294
3,189,096 A * 6/1965 Fladger ..... 166/133
3,248,129 A * 4/1966 Brown ..... 285/18
3,329,209 A * 7/1967 Kisling, III ..... 166/128
3,494,418 A * 2/1970 Young ..... 166/123
4,289,205 A * 9/1981 Mott ..... 166/377
4,346,761 A * 8/1982 Skinner et al. ..... 166/206
4,403,659 A * 9/1983 Upchurch ..... 166/374
4,420,044 A * 12/1983 Pullin et al. ..... 166/322
4,445,572 A * 5/1984 Fineberg et al. ..... 166/188
4,452,472 A * 6/1984 Crase ..... 285/3
4,484,633 A * 11/1984 Brandell ..... 166/301
4,700,778 A * 10/1987 Smith et al. ..... 166/254.2
4,817,723 A * 4/1989 Ringgenberg ..... 166/321
4,915,175 A * 4/1990 Mashaw, Jr. ..... 166/332.7
5,219,027 A * 6/1993 Taylor ..... 166/377
5,372,197 A * 12/1994 Wacker ..... 166/311
6,889,771 B1 * 5/2005 Leising et al. ..... 166/373

* cited by examiner

*Primary Examiner*—David Bagnell
*Assistant Examiner*—David Andrews
(74) *Attorney, Agent, or Firm*—John W. Wustenberg; Groover and Associates

(57) ABSTRACT

A method of operating a safety joint that allows disconnection from a downhole section of a drill string without rotating the drill string. In an example class of embodiments, the innovative safety joint includes a sleeve with a j-slot that fits to a lug attached to the mandrel. A piston is attached to the sleeve. The safety joint is disconnected by first pulling up on the string to shear a set of shear pins, the upward movement also lifting the sleeve and piston. As the piston lifts, a passage through a part of the piston allows fluid to move from an upper chamber to a lower chamber. A valve prevents fluid from moving back up into the upper chamber, so that the lower chamber acts as a stop to prevent the piston and sleeve from lowering again. Downward pressure on the drill string forces a lug against the j-slot, causing the sleeve to rotate until the lug is aligned with a vertical slot of the j-slot. Subsequent upward movement on the drill string pulls the lug free of the j-slot, thus achieving disconnect of the two parts of the drill string.

17 Claims, 7 Drawing Sheets

METHOD FOR UTILIZING DOWNHOLE SAFETY JOINT

BACKGROUND AND SUMMARY OF THE INVENTION

The present application relates to downhole drilling tools, and more particularly to a safety joint that provides separation of a downhole assembly at the location of the safety joint.

DESCRIPTION OF BACKGROUND ART

Safety joints are known in the oil and gas industry for use in downhole assemblies to provide a point of separation at the location of the safety joint. Safety joints are used in a variety of circumstances, including fishing operations and during normal operations to allow the majority of the string to be recovered should some element lower on the string become stuck.

Safety joints are often run just above a packer, so that the greatest number of tools can be removed. Other safety joints are run below a packer. The applicability of a safety joint to either of these circumstances depends on the order of operations used to disconnect the safety joint and to set the packer. If a safety joint below a packer disconnects using the same order of operations as setting the packer, then it will not be known which tool received the operation.

Typical safety joints require many rotations of the drill string, often in combination with downward force, to transmit a high level of torque along the drill string to thereby separate the string at the safety joint. Major components of the safety joint are normally connected by a threaded section and are separated by reverse rotation of the string. The safety joint threaded section typically is designed to unscrew at lower torque than other parts of the drill string. Because torque often does not transmit well along the drill string, many rotations are required, and the string itself can be put under large amounts of force. This can damage the drill string and takes time to accomplish.

This, there is a need in the art for a way to disconnect tools from a drill string, or to separate two parts of a drill string, without the need to perform rotations of the drill string.

Safety Joint

In one example embodiment, the present innovations describe a tool release system, preferably used in the context of a downhole drill string, that permits disconnection from a downhole tool (or other part of the string) without the need to rotate the string. In one class of preferred embodiments, the present innovations include a j-slot sleeve that aligns with lugs on the mandrel. An upward stroke breaks shear pins, raises the j-slot sleeve, and allows a chamber to fill with liquid. The liquid-filled chamber holds the j-slot sleeve up as a downward stroke causes the sleeve to rotate (by interaction of the lug and the j-slot). Once the sleeve is rotated, the lug is in a position to slide upward and out of the j-slot sleeve, thereby disengaging from the sections of the string below the sleeve.

The disclosed innovations, in various embodiments, provide one or more of at least the following advantages:

- no rotation of the drill string is required making recovery easier in deep or deviated wells;
- torque can be freely applied for other operations without concern for accidentally releasing the safety joint;
- disconnect from downhole tools can be accomplished in a short period of time.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

Figure 1:
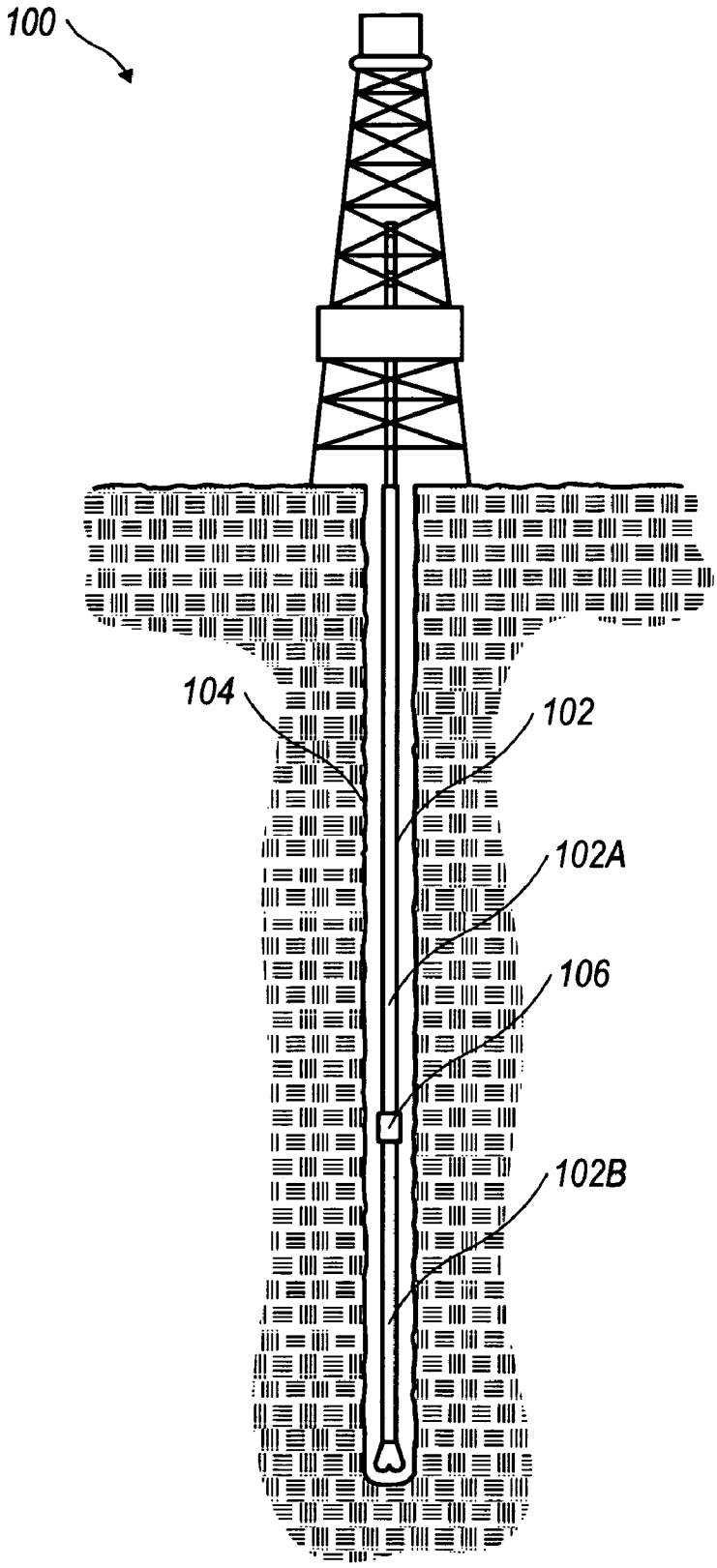
FIG. 1 shows an overview of an oil rig system consistent with implementing a preferred embodiment of the present innovations.

FIG. 1 shows an overview of a system consistent with implementing a preferred embodiment of the present innovations. In an oil drilling system 100, drill string 102 extends down a borehole 104. The string 102 has sections 102A, 102B, that are connected by a safety joint 106. For example, section 102B, can be a downhole tool such as a perforating gun if the gun becomes stuck following perforation and testing. Drill string 102 also normally includes a outer case (not shown) that encloses parts of the string, normally including the safety joint 106.

As described above, the present innovations provide systems and methods for disconnecting from a tool, for example, below a packer, without requiring rotation of the drill string. In one class of preferred embodiments, this is accomplished with the use of a j-slot sleeve. For example, in one class of embodiments, lugs on the mandrel align in the j-slot sleeve. The lugs on the mandrel are at the end of the j-slot when the tool is run into the hole. There are preferably interlocking splines on the mandrel and the outer case above the lugs, and a shear-set sleeve above the splines. A piston with check valves attached preferably attach to the bottom of the j-slot sleeve, and o-rings or other seals create upper and lower chambers for fluids, preferably oil, though any fluid can be used. The upper and lower chambers are preferably formed between the outer case and part of the piston, and the mandrel. The check valves allow oil to flow from the upper chamber to the lower chamber (upon certain conditions) but not in the opposite direction. In the run-in position, the mandrel is preferably bottomed against the outer case. The j-slot sleeve and the piston are preferably bottomed against ledges in the outer case. Thus, the j-slot sleeve, the mandrel with lugs, the outer case, and the interlocking splines comprise an "unlocking mechanism." The piston with check-valves, the o-rings or other seals forming the upper and lower chambers, the oil or other fluid and the outer case comprise a "hydraulic mechanism."

In one example mode of operation, an upward force is applied to the mandrel which shears the shear pins in the shear-set sleeve. The lug on the mandrel pulls the j-slot sleeve and piston upward. Oil (or another fluid) passes through a passage in the piston and the check valve from the upper chamber into the lower chamber, until the j-slot sleeve stops against the bottom of an upper ledge in the outer case. Downward force applied to the mandrel raises the pressure in the lower chamber, holding the j-slot sleeve and piston (which are preferably rigidly connected) upward, so that a downward force on the mandrel causes the lug to force the j-slot sleeve to rotate, aligning the lug with the vertical slot of the j-slot sleeve. When the lug is so aligned, upward motion on the mandrel pulls the mandrel free of the j-slot sleeve, accomplishing disconnect.

Figure 2:
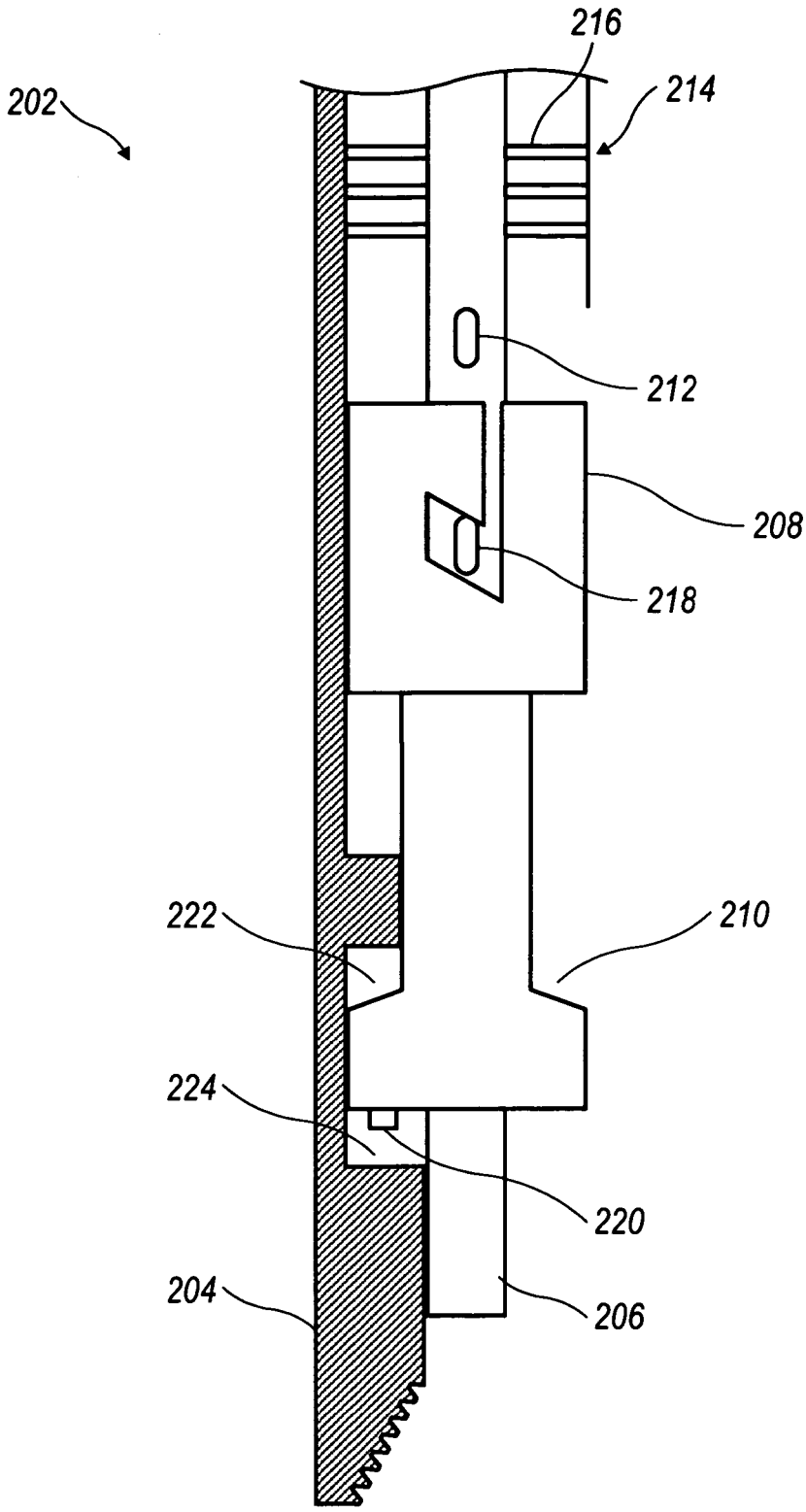
FIG. 2 shows an example embodiment of a safety joint consistent with a preferred embodiment of the present innovations.

FIG. 2 shows an example implementation consistent with implementing a preferred embodiment of the present innovations. A drill string 202 includes outer case 204 and mandrel 206. Mandrel 206 includes j-slot sleeve 208 and piston 210. Splines 212 extend from the mandrel 206 and interlock with grooves on the inside of case 204 to prevent rotation between the mandrel and the case. The system also preferably includes a shear set sleeve 214 that has shear pins 216 which can be sheared by an upward stroke of predetermined force. Mandrel 206 also includes lug (or lugs) 218 that fit into a slot of the j-slot sleeve 208. In some preferred embodiments, splines 212 and lugs 218 align with one another vertically. The system also includes a valve 220 between upper chamber 222 and lower chamber 224, with chambers 222 and 224 being formed between the mandrel and the outer case. Chambers 222 and 224 are preferably separated by a portion of piston 210, such that when piston 210 is raised, fluid can flow from upper chamber 222 into lower chamber 224. Valve 220 is preferably one-way, allowing fluid to flow as described and preventing backflow. Valve 220 is preferably located at a passage (not shown, see FIG. 3) that goes through piston 210. Upper chamber 222 and lower chamber 224 are also separated by o-rings (not shown, see FIG. 3) or some other sealing apparatus to prevent unwanted fluid flow between them.

In some preferred embodiments, the described innovations allow separation from a downhole tool without requiring rotation of the drill string. Sleeve 208 can rotate with respect to case 204 and mandrel 206. An upward stroke shears shear pins 216 and moves the mandrel, sleeve, and piston upward with respect to the case. This upward movement separates piston 210 from valve 220, allowing fluid to pass from upper chamber 222 into lower chamber 224. Upward movement preferably stops when j-slot sleeve stops against the bottom surface of a ledge (not shown) of the outer case 204. Next, a downward force is applied to the mandrel 206 raising the fluid pressure in the lower chamber 224 (because the valve 220 prevents fluid from passing back into upper chamber 222). The pressure of the fluid in the lower chamber holds the j-slot sleeve and piston upward while the downward force on the mandrel allows lug 218 to force the sleeve 208 to rotate. This rotation aligns the lug with the vertical slot of the sleeve, so that upward force can pull the lug (and mandrel) free of the sleeve and the rest of the tool. Sleeve 208 and piston 210 remain in the hole.

Thus, the present innovation, in this example embodiment, allows separation of the drill string from a lower section of the drill string, such as a tool connected below the safety joint. This separation is accomplished without the need to rotate the drill string, which can be a great advantage in deviated wells where rotation is difficult to transmit downhole. The non-rotational separation mechanism also allows torque to be applied as needed for other operations without danger of releasing the safety joint. The innovative system also allows separation in a relatively short amount of time and movement (upward stroke, downward stroke, pull out) compared to other systems.

Figure 3:
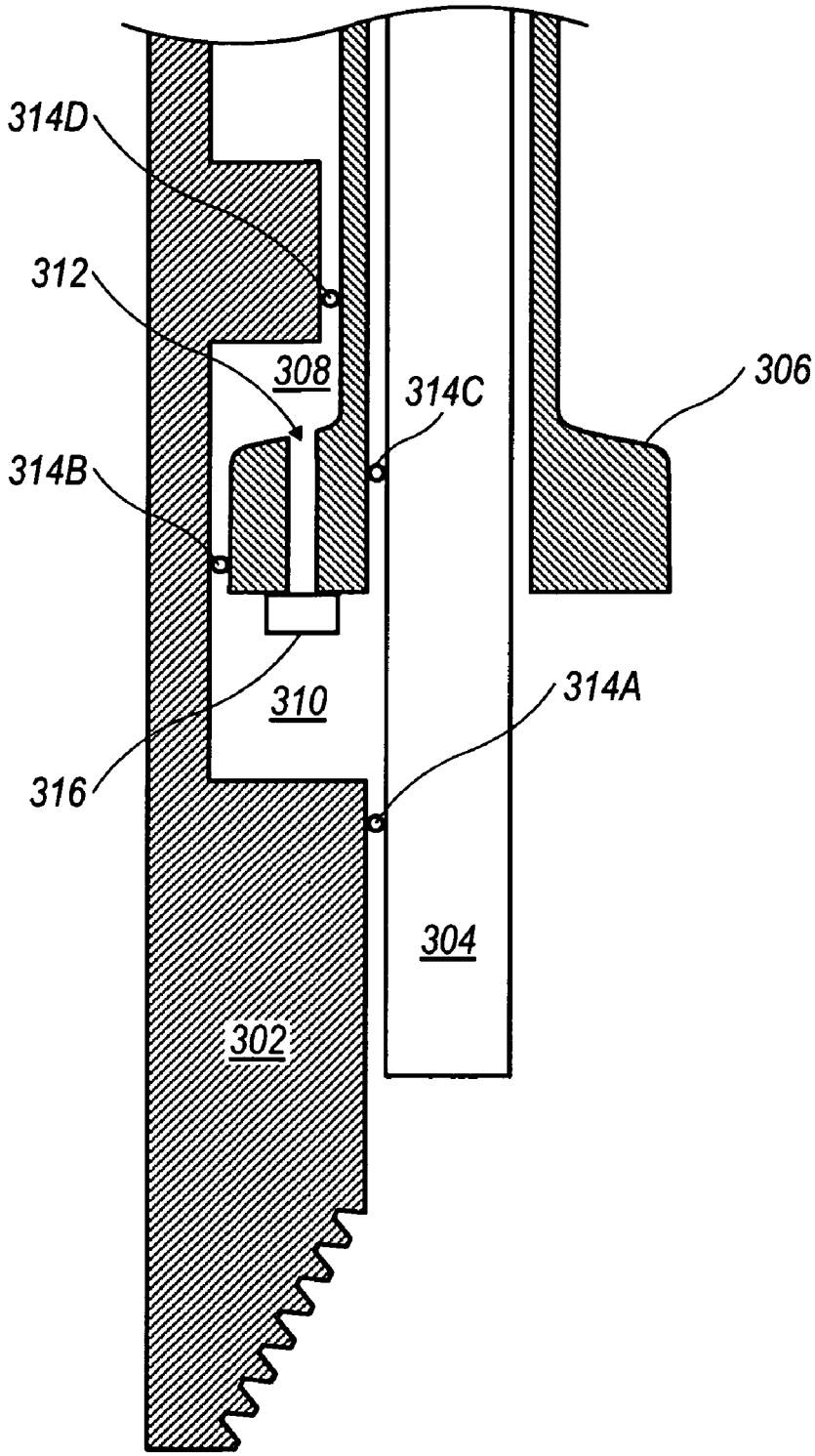
FIG. 3 shows a detail of an example embodiment consistent with a preferred embodiment of the present innovations.
Figure 7:
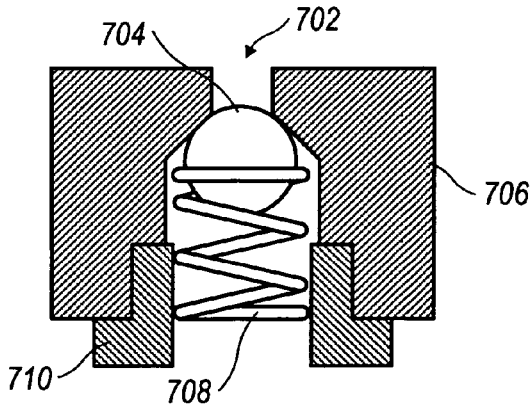
FIG. 7 shows a check valve consistent with a preferred embodiment of the present innovations.

FIG. 3 shows a cross section of the piston 306, mandrel 304, and outer case 302 consistent with a preferred embodiment of the present innovations. Piston 306 includes a passage 312 between upper chamber 308 and lower chamber 310. The two chambers 308, 310 are separated by o-rings 314A-314D which provide a seal to prevent passage of fluid between the chambers except as through one-way valve 316. Valve 316 is preferably located at bottom of passage 312. Valve 316 is preferably a one-way valve. On an upward stroke, piston 306 moves upward, opening valve 316 to allow fluid to pass from upper chamber 308 to lower chamber 310. An illustrative example of a check valve consistent with a preferred embodiment is depicted in FIG. 7, below.

Figure 4:
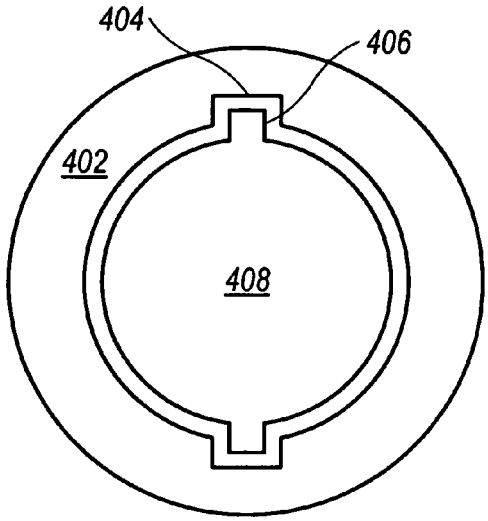
FIG. 4 shows a top-view of an innovative system consistent with a preferred embodiment of the present innovations.

FIG. 4 shows a top-down view of one cross section of the innovative assembly. Outer case 402 has slots 404 that align with splines 406 to prevent rotation of the mandrel 408 with respect to the outer case 402. Lugs (not shown, see lugs 218 of FIG. 2) align vertically with splines 406, so that when the mandrel is detached from a downhole tool, the mandrel can be pulled free.

Figure 5:
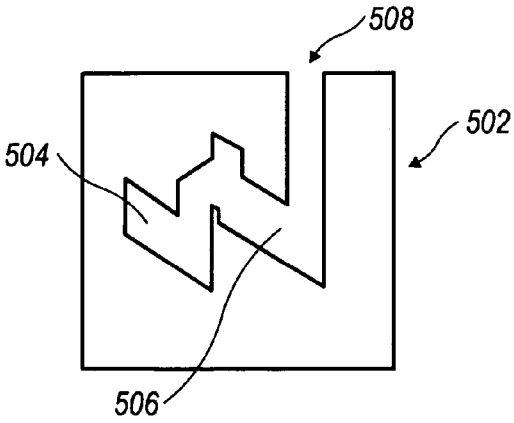
FIG. 5 shows an alternative sleeve consistent with an embodiment of the present innovations.

FIG. 5 shows another embodiment of the j-sleeve 502 consistent with a preferred embodiment of the present innovations. In this example, j-sleeve 502 includes a more complex slot formation so that multiple strokes are required to disconnect the drill string. For example, sleeve 502 can include a first section 504 where a lug (e.g., lug 218) is positioned during normal operation. Sleeve 502 also includes a second section 506. This sleeve will not disengage with the up-down-up strokes that release the embodiment described, for example, in FIG. 2. Instead, the first upward stroke and downward stroke move the lug from section 504 into section 506. A second downward stroke is needed to align the lug with the escape slot 508 before it can be pulled free. This example is intended to show that other shapes of the sleeve 502 can be implemented within the context of the present innovations. The examples presented are only intended to be illustrative, and are not intended to limit embodiments of the present innovations.

Figure 6:
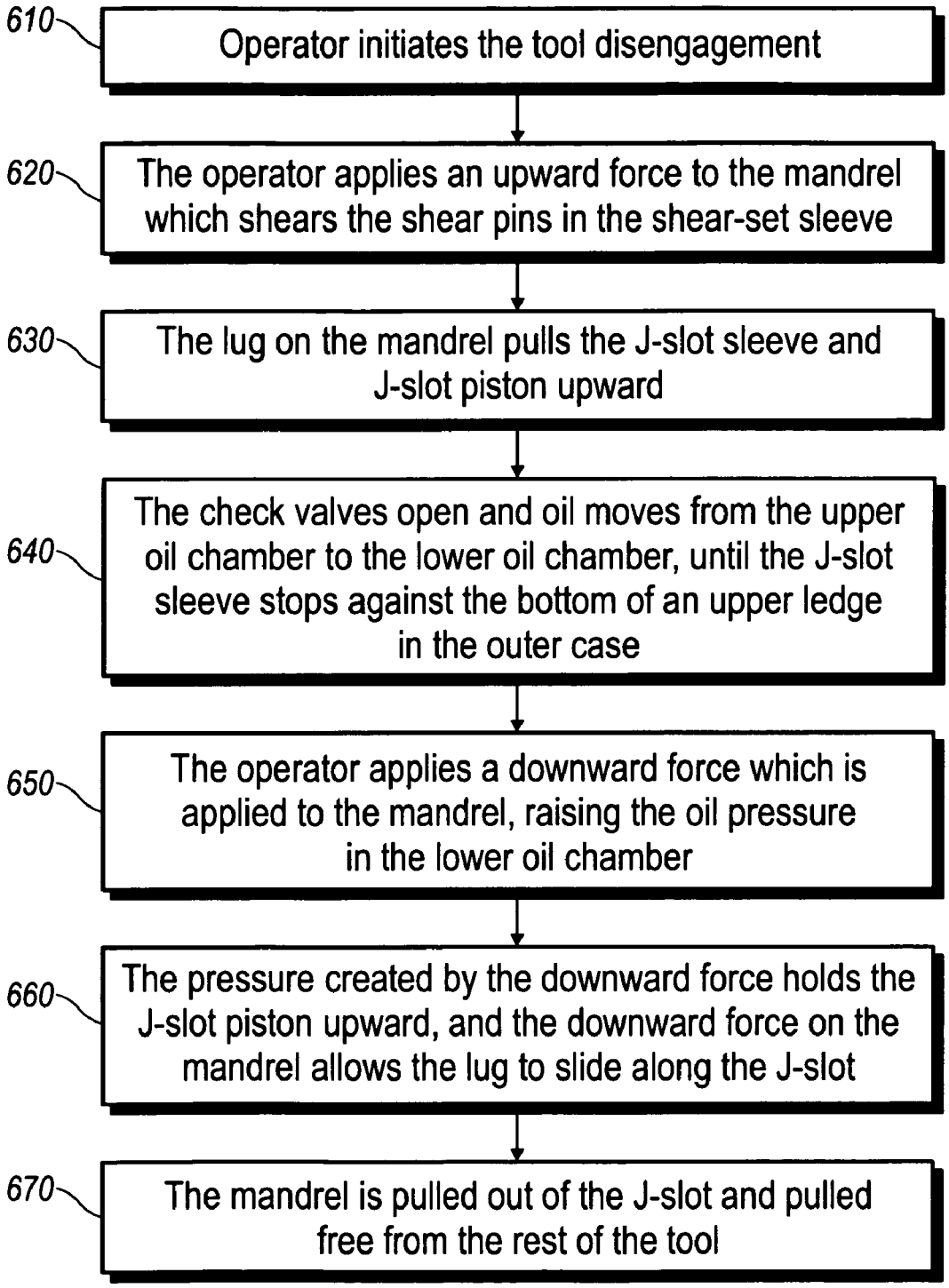
FIG. 6 shows a flowchart with process steps consistent with implementing a preferred embodiment of the present innovations.

FIG. 6 shows a flowchart with steps consistent with a preferred embodiment of the present innovations. First, the operator initiates the tool disengagement (step 610). Next, the operator applies an upward force to the mandrel which shears the shear pins in the shear-set sleeve (step 620). After this force is applied, the lug on the mandrel pulls the J-slot sleeve and J-slot piston upward (step 630). Check valves open on the piston and fluid moves from the upper chamber to the lower chamber until the J-slot sleeve stops against the bottom of an upper ledge in the outer case (step 640). The operator then applies a downward force to the mandrel, raising the oil pressure in the lower oil chamber (step 650). The pressure created by the downward force holds the J-slot piston upward, and the downward force on the mandrel allows the lug to slide along the J-slot and turned the J-slot sleeve (step 660). The mandrel is pulled out of the J-slot and pulled free from the rest of the tool (step 670).

The process steps shown in FIG. 6 can of course be modified to include more strokes, so that, for example, a sleeve such as that depicted in FIG. 5 can be used. In some preferred embodiments, the drill string need not be rotated in order to disengage the safety joint. Simple up and down movement, by virtue of the j-slot and lugs described above, causes the j-slot sleeve to rotate, unlocking the two parts of the drill string to be separated.

FIG. 7 shows an example check valve consistent with a preferred embodiment of the present innovations. This example is intended to be illustrative only, and is not intended to limit in any way the type of valve capable of being implemented within the context of the present innovations.

Check valve 700 includes an opening or passage 702 through housing 706 which, under certain conditions, permits passage of fluid through the valve. In this example, the valve is a one-way valve that operates by differential pressure. High pressure from above (in the orientation shown) pushes ball 704 away from its seat blocking passage 702. This causes action in spring 708, which is compressed. As long as the pressure differential exists, the valve remains open. When pressure equalizes (or the differential is reduced to less than the force applied by spring 708) the spring pushes the ball 704 back into seat, closing the valve. Cap 710 holds spring 708 and ball 704 in place.

Figure 8D:
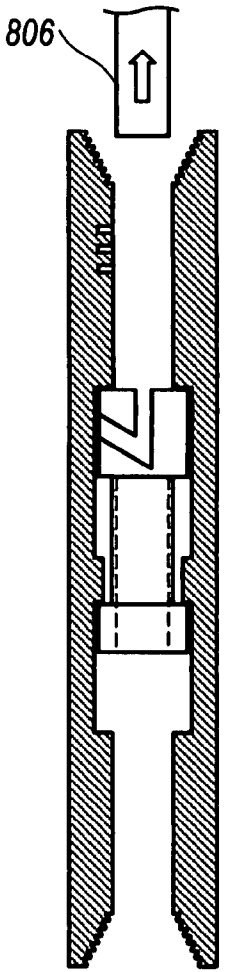
FIGS. 8A-8D show a system consistent with a preferred embodiment at different times during disengagement.
Figure 8C:
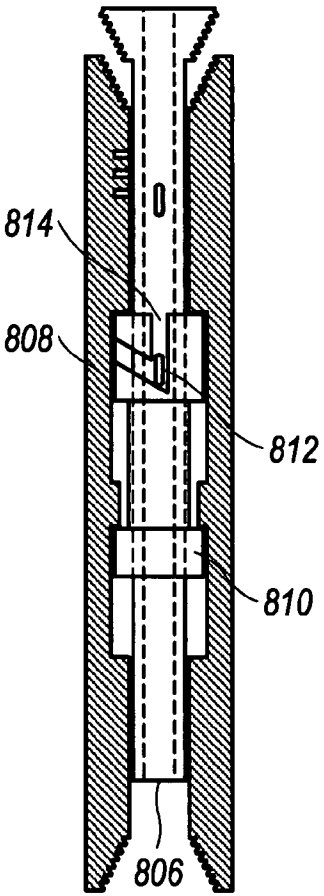
Figure 8B:
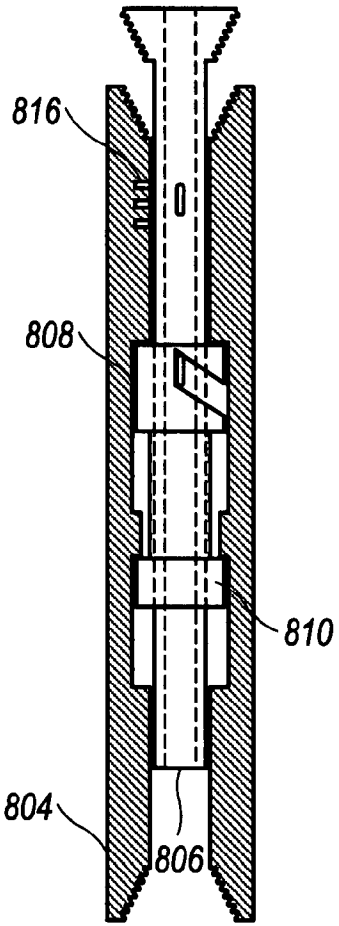
Figure 8A:
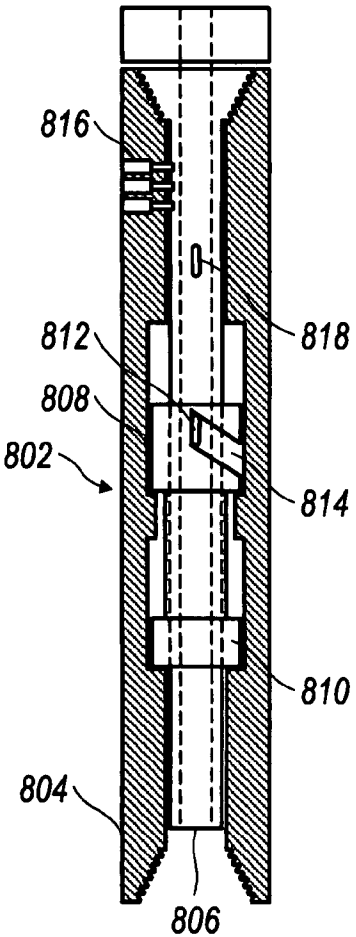

FIGS. 8A-8D show an illustrative example of the present innovations being used, showing the system at four different points in time. In FIG. 8A, a drill string 802 includes outer case 804 and mandrel 806. J-slot sleeve 808 and attached piston 810 are shown in position on the mandrel, with lug 812 fit within j-slot 814 of sleeve 808. Spline 818 is shown above and preferably aligned with lug 812. Shear pins 816 are shown above spline 818, though these elements can vary in their relative arrangement. When the operation begins, mandrel 806 and case 804 are in the position shown in FIG. 8A. Piston 808 is at its bottom position, resting against a ledge of case 804.

The operation to separate the safety joint begins with the operator lifting the string, shearing shear pins 816 as shown in FIG. 8B. This allows mandrel 806 to slide upward, bringing j-slot sleeve 808 and piston 810 into lifted positions, preferably stopping at a lower side of a ledge on casing 804.

At this point in an example preferred process, a mechanism is engaged that holds the sleeve 808 and piston 810 in their up positions. Several ways of performing this can be implemented (see FIGS. 9-11), though in some embodiments, a one-way check valve as described above is used. The check valve is preferably located in the piston, with o-rings that create an upper chamber between the outer case and the top of the piston, and more o-rings that create a lower chamber between the bottom of the j-slot sleeve, the mandrel, and the outer case. The check valve allows oil to flow from the upper oil chamber to the lower chamber, but prevents oil from moving back up into the upper chamber from the lower chamber.

Next the mandrel 806 is pressed down, while the sleeve 808 and piston 810 remain up. This action causes lug 812 to slide in slot 814, which in turn causes sleeve 808 to rotate as shown. This rotation aligns the lug 812 with the vertical part of the slot. This configuration is shown in FIG. 8C.

Next the mandrel 806 is pulled free, separating the safety joint. This is depicted in FIG. 8D.

Figure 9A:
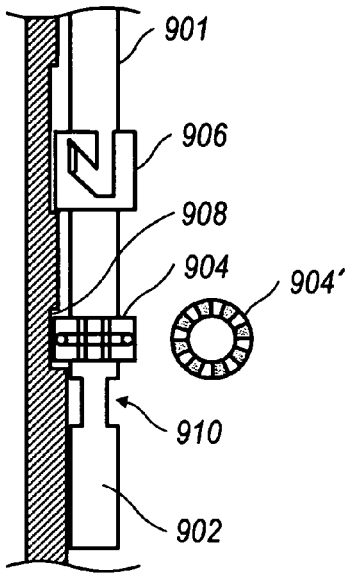
FIGS. 9A-9B show an example alternative embodiment consistent with the present innovations.
Figure 9B:
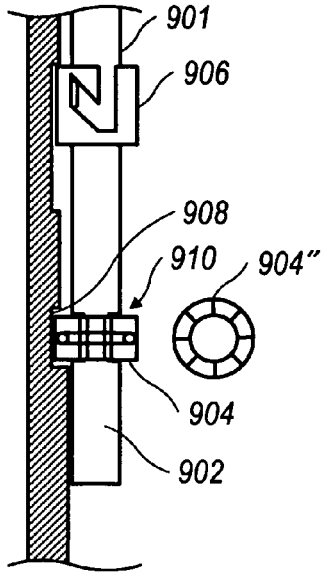

FIGS. 9A and 9B show another embodiment, with two parts to the mandrel, namely, upper mandrel part 901 and lower mandrel part 902. In this example embodiment, the system includes segmented blocks and springs assembly 904 at a point below the j-slot sleeve 906, corresponding with slot 908 in the outer casing. The lower mandrel part 902 also includes, in this embodiment, a notch or cutout 910 beneath the assembly 904. The same embodiment is shown in a different position in FIG. 9B. The assembly 904 slides along the lower mandrel part 902 as the drill string is pulled up, until the assembly catches in cutout 910. The upward movement also simultaneously moves j-slot sleeve 906 upward. J-slot sleeve 906 is held in this up position once the assembly 904 catches in cutout 910. In some embodiments, slot 910 can have the bottom ledge made at an angle so that mandrel 902 can be pulled free, though this is not necessary. Assembly 904 prevents the j-slot sleeve 906 from moving downward. In some embodiments, sleeve 906 and lower mandrel part 902 can be made as one part, or as separate parts. Upper mandrel part 901 preferably is integral with the lug that catches the j-slot sleeve 906. When the lug on mandrel 901 aligns with the slot on sleeve 906, upper mandrel part 901 can be pulled free.

Figure 10A:
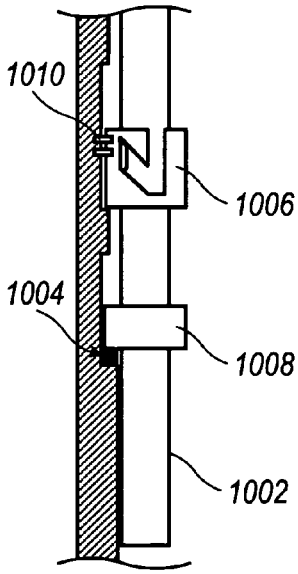
FIGS. 10A-10B show an example alternative embodiment consistent with the present innovations.
Figure 10B:
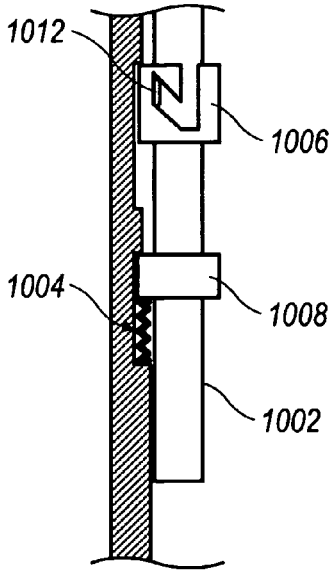

FIGS. 10A and 10B show another embodiment consistent with the present innovations. In this example, a preloaded spring 1004 and second set of shear pins 1010 are used to prevent the j-slot sleeve 1006 from sliding down once the mandrel 1002 is raised. Spring 1004 starts in a compressed state as shown in FIG. 10A, between a ledge of the outer casing and a bottom side of a piston 1008 attached to the j-slot sleeve 1006. When the mandrel 1002 is lifted (as shown in FIG. 10B) the spring 1008 expands as shear pins 1010 are broken, allowing the j-slot sleeve 1006 to rise. The expanded spring 1004 is strong enough to carry the weight of the j-slot sleeve and the force necessary to allow the j-slot sleeve to turn by action of the lug 1012 as the mandrel is pushed down again. Once the slot of j-slot sleeve 1006 is aligned with lug 1012 the mandrel can be lifted free and the safety joint thereby separated.

Figure 11:
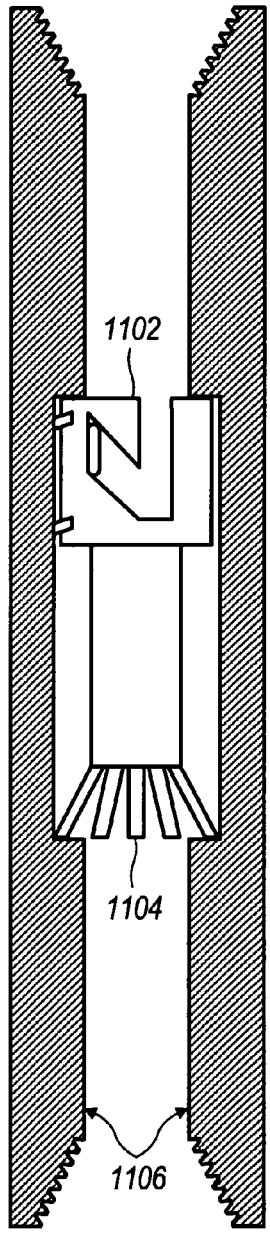
FIG. 11 shows an example alternative embodiment consistent with the present innovations.

FIG. 11 shows another embodiment consistent with the present innovations. In this example, the j-slot sleeve 1102 has attached thereto (such as a modified piston, for example) a set of collets or fingers 1104 that are spring loaded to splay outward. While in narrow region 1106 of outer casing, the fingers 1104 slide freely. However, once the j-slot sleeve 1102 is lifted to a point where the fingers 1104 are above a ledge in the outer casing, they expand so as to catch the upper side of the ledge, thereby preventing j-slot sleeve 1102 from moving downward again.

These examples are only intended to be illustrative, and show that a variety of implementations are possible within the scope of the present innovations. Other systems or mechanisms that prevent the j-slot sleeve from sliding down can be implemented as well.

As described in the illustrative examples given above, the present innovations provide systems and method for disconnecting a drill string without requiring rotation of the drill string. Instead, a connecting portion of the drill string (in the examples presented, the j-slot sleeve) rotates by virtue of up and down motion only from the perspective of the operator. The up and down motion (in varying combinations or orders, depending on implementation) is causes, in some examples, the sleeve to rotate, freeing a lug that is otherwise not free of the sleeve.

According to a disclosed class of innovative embodiments, there is provided: A method of disconnecting two parts of a drill string, comprising the steps of: (a) exerting a force on the drill string to thereby cause a sleeve positioned on the drill string to rotate; (b) exerting an opposite force on the drill string to thereby cause a lug to slide clear of the sleeve; wherein when the lug slides clear of the sleeve, the two parts of the drill string are separated.

According to a disclosed class of innovative embodiments, there is provided: A method of separating two parts of a drill string, comprising the steps of: moving the drill string to move a sleeve from a first position into a second position; filling a chamber with fluid to prevent the sleeve from moving into the first position; moving the drill string to thereby cause the sleeve to rotate.

According to a disclosed class of innovative embodiments, there is provided: A method of disconnecting a downhole tool, comprising the steps of: applying a force in a first direction to the drill string; applying a force in a second direction; to thereby operate a locking mechanism which disconnects the downhole tool.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, the present innovations can be implemented multiple times to permit selective disconnection of the string at different locations. For example, if two different innovative safety joints were implemented, they could differ by the lengths of the j-slots in their j-slot sleeves, so that movement that disengages one j-slot from its lugs does not disengage the second j-slot from its lugs. Likewise, different strength shear pins can be used, so that the initial upstroke shears one set of shear pins but does not break a second set of shear pins. In this example, the j-slot sleeves could be identical while still allowing selective disengagement between two different safety joints.

The fluid chambers of the present innovations are one mechanism by which the sleeve and/or piston can be held in an upward position while allowing the mandrel to move downward.

For another example, though the piston with the fluid passage is described as a separate element from the sleeve, the fluid passage and chambers can be implemented such that the piston is subsumed into the sleeve element or becomes unnecessary. In other words, the sleeve itself can be made to serve the functions described herein as being performed by the piston.

In another example, the upward and downward movements described in the example embodiments can be replaced, for example, with opposite movement, where applicable. For example, in some embodiments, an upward-downward-upward sequence is described. In such cases, opposite movements (e.g., downward-upward-downward) can be used, with corresponding variations in the fabrication of the mechanical parts necessary to implement such a change.

Rotation of the drill string is generally not required in most example embodiments. It is understood that movement of the drill string can cause some minor rotations that are not part of the intended or forced action on the drill string by an operator. For example, pulling straight up on the drill string may allow some minor level of vibration or rotation in some part of the drill string (for example, within the mechanical tolerances of the parts, or "play" in the drill string). However, this minor, insubstantial movement of the drill string is not considered "rotation" of the drill string.

Additional general background, which helps to show variations and implementations, may be found in the following publications, all of which are hereby incorporated by reference:

"Petroleum Production Systems," Economides, Hill, Ehlig-Economides, Prentice-Hall PTR (1994); "Production Operations" (volumes 1 and 2), Allen and Roberts, OGCI Inc., (1978).

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A method of disconnecting two parts of a drill string, comprising the steps of:

(a) exerting a force on the drill string to thereby cause a sleeve positioned on the drill string to rotate; and (b) exerting an opposite force on the drill string to thereby cause a lug to slide clear of the sleeve;

wherein when the lug slides clear of the sleeve, the two parts of the drill string are separated with substantially no rotation of the drill string.

2. The method of claim 1, wherein step (a) includes:

(i) exerting an opposite force on the drill string at least once more to thereby cause a lug to slide but not slide clear of the sleeve; and (ii) exerting a force on the drill string after each at least once more opposite force is exerted to thereby cause a sleeve positioned on the drill string to rotate.

3. The method of claim 1, wherein the sleeve is a j-slot sleeve.

4. The method of claim 1, further comprising an assembly which, prior to step (a), prevents motion of the sleeve in at least one direction.

5. A method of disconnecting two parts of a drill string, comprising the steps of:

(a) exerting a force on the drill string to thereby shear one or more shear pins and lift a piston rigidly attached to the sleeve from a first position to a second position; wherein when the piston moves to the second position, a chamber fills with fluid; and wherein the chamber filled with fluid prevents the piston from moving to the first position again;

(b) exerting a force on the drill string to thereby cause a sleeve positioned on the drill string to rotate; and (c) exerting an opposite force on the drill string to thereby cause a lug to slide clear of the sleeve;

wherein when the lug slides clear of the sleeve, the two parts of the drill string are separated.

6. The method of claim 5, wherein the piston includes a passage through which the liquid enters the chamber; and wherein a valve prevents the fluid from exiting the chamber through the passage.

7. A method of separating two parts of a drill string, comprising the steps of:

moving the drill string to move a sleeve from a first position into a second position;

irreversibly filling a chamber with a fluid using a valve to prevent the sleeve from moving back into the first position again; and moving the drill string to thereby cause the sleeve to rotate.

8. The method of claim 7, wherein when the sleeve rotates, it aligns a lug with a vertical slot of the sleeve, and when the drill string is subsequently lifted, the lug is pulled free of the sleeve to thereby separate the two parts of the drill string.

9. The method of claim 7, wherein the step of moving the drill string to thereby cause the sleeve to rotate is performed without rotating the drill string.

10. The method of claim 7, wherein one of the parts of the drill string to be separated comprises an attached tool.

11. The method of claim 7, wherein a check valve irreversibly prevents fluid from exiting the chamber.

12. The method of claim 7, wherein the valve is a one-way valve.

13. A method of disconnecting a downhole tool, comprising the steps of:

applying a force in a first direction to a drill string;

applying a force in a second direction;

to thereby operate an unlocking mechanism operable to irreversibly disconnect the downhole tool;

wherein a hydraulic mechanism operates to permit said unlocking mechanism to release said drill string from said downhole tool without substantial rotation between said drill string and said downhole tool; and wherein the step of applying a force in the second direction causes a j-slot sleeve to rotate, to thereby align a lug with a slot of the j-slot sleeve.

14. A method of disconnecting a downhole tool, comprising the steps of:

applying a force in a first direction to a drill string;

applying a force in a second direction;

to thereby operate an unlocking mechanism operable to irreversibly disconnect the downhole tool;

engaging a slot in an outer casing with a segmented block and spring assembly when a force is applied in the first directions;

wherein a hydraulic mechanism operates to permit said unlocking mechanism to release said drill string from said downhole tool without substantial rotation between said drill string and said downhole tool.

15. A method of disconnecting a downhole tool, comprising the steps of:

applying a force in a first direction to a drill string;

applying a force in a second direction;

to thereby operate an unlocking mechanism operable to irreversibly disconnect the downhole tool;

wherein a hydraulic mechanism operates to permit said unlocking mechanism to release said drill string from said downhole tool without substantial rotation between said drill string and said downhole tool;

wherein the step of applying a force in the second direction causes a j-slot sleeve to rotate, to thereby align a lug with a slot of the j-slot sleeve; and wherein when the lug is aligned with the slot of the j-slot sleeve, the downhole tool can be separated from the drill string.

16. A method of allowing recovery of a portion of a drill string from a well bore when an element of the drill string becomes stuck in the well bore, comprising:

moving the drill string to move a sleeve from a first position into a second position;

irreversibly filling a chamber with a liquid using a valve to prevent the sleeve from moving back into the first position again; and moving the drill string to thereby cause the sleeve to rotate.

17. A method for drilling a well bore, comprising:

rotating a drill string within a well bore;

having a down-hole tool get stuck in said well bore; and releasing an unlocking mechanism, said unlocking mechanism comprising:

a sleeve positioned around a portion of a drill string;

a lug positioned to fit in a slot of said sleeve;

a hydraulic mechanism comprising a piston which slides along a wall of a respective liquid-filled cavity, which separates first and second portions of said cavity to substantially block liquid flow therebetween, said piston having a passage therethrough, and a check valve controlling movement of said liquid through said passage of said piston;

wherein said hydraulic mechanism operates to permit said sleeve and said lug to release said drill string from said stuck down-hole tool without any rotation between said drill string and said stuck down-hole tool.

* * * * *